US005127551A

United States Patent [19]

Black et al.

[11] Patent Number: 5,127,551

[45] Date of Patent: Jul. 7, 1992

[54] HIGH CAPACITY BEVERAGE DISPENSING SYSTEM

[75] Inventors: William J. Black, Coon Rapids; Scott C. Milton, St. Paul, both of Minn.

[73] Assignee: IMI Cornelius Inc., Anoka, Minn.

[21] Appl. No.: 616,117

[22] Filed: Nov. 20, 1990

[51] Int. Cl.[5] ..... B67D 5/56

[52] U.S. Cl. ..... 222/129.1; 222/146.6; 222/318; 137/340; 137/561 A; 137/563; 62/390; 62/396

[58] Field of Search ..... 222/129.1–129.4, 222/146.1, 146.6, 318; 137/339, 340, 561, 563, 627, 599, 602, 896; 62/389, 390, 391, 393, 396, 434, 436, 430; 261/DIG. 7

[56] References Cited

U.S. PATENT DOCUMENTS

| | | | |
|---|---|---|---|
| 3,460,713 | 8/1969 | Cornelius | 222/129.1 X |
| 4,216,879 | 8/1980 | McMillin | 222/146.6 X |
| 4,679,408 | 7/1987 | Nelson | 62/396 X |
| 4,781,309 | 11/1988 | Vogel | 137/561 A |
| 4,913,183 | 4/1990 | Vogel et al. | 222/129.1 X |

FOREIGN PATENT DOCUMENTS

| | | | |
|---|---|---|---|
| 271414 | 11/1966 | Australia | 222/129.1 |
| 2194508 | 3/1988 | United Kingdom | 222/129.1 |

*Primary Examiner*—Michael S. Huppert
*Assistant Examiner*—Kenneth DeRosa
*Attorney, Agent, or Firm*—Sten E. Hakanson

[57] ABSTRACT

The present invention is a beverage dispensing system for providing the parallel connection of a plurality of refrigeration sources responsible for the cooling of associated beverages dispensed from a plurality of dispensing valves. A coolant fluid, such as carbonated water, is cooled by each refrigeration unit and is then co-mingled in a common outflow manifold prior to distribution to each of the valves. Likewise, each similar beverage cooled by each refrigeration unit can be co-mingled in a particular manifold before distribution to each of the dispensing valves. Thus, the failure of one refrigeration unit does not to require the shut-down of a valve or valves, as carbonated water and beverages cooled thereby are co-mingled with the carbonated water and same beverages continuing to be cooled by the remaining functioning refrigeration units prior to delivery thereof to the valves.

25 Claims, 3 Drawing Sheets

HIGH CAPACITY BEVERAGE DISPENSING SYSTEM

BACKGROUND

1. Field of the Invention

The present invention relates generally to beverage dispensing systems and, in particular, systems capable of dispensing a high volume of properly refrigerated beverage.

2. Background of the Invention

High capacity beverage dispensing systems are known that allow for the dispensing of large volumes of refrigerated beverage while maintaining the proper temperature thereof. Such systems generally include a remotely located refrigeration unit for cooling the various beverage components, such as carbonated water and syrup, and a dispensing unit having a plurality of valves located in the retail area for dispensing of the drinks. In such prior art systems, each refrigerated unit is responsible for the refrigerating of a specific set of beverage components, which are then routed directly to the particular beverage dispensing station. Thus, there is a one-to-one correlation between the refrigeration apparatus and the dispensing station. The problem with the prior art concerns the situation where a refrigeration unit fails, wherein the associated beverage dispenser must be taken out of service until its refrigeration unit can be replaced or repaired. Accordingly, it would be very desirable to have a beverage dispensing system wherein the failure of a refrigeration unit would not result in the removal from service of a corresponding beverage dispensing station.

SUMMARY OF THE INVENTION

The present invention concerns a high capacity beverage dispensing system having multiple refrigeration units and multiple beverage dispensing stations connected in parallel. Each refrigeration unit includes a chilled water bath for cooling the carbonated water and syrup beverage components through heat exchange with carbonated water and syrup lines extending therethrough. Each refrigeration unit also includes a carbonator connected to a regulated source of compressed carbon dioxide and a source of potable water. The carbonator includes an outlet connected by a T-fitting, to a circulating carbonated water line. The circulating carbonated water line of each refrigeration unit is connected to a first carbonated water manifold. The carbonated water mixes in the first manifold and is divided to flow individually through a first group of heat exchange syrup manifolds and then to each of the beverage dispensing stations. Each beverage dispensing station has a circulating carbonated water outlet line that flows first separately through the remaining or second group of syrup manifold heat exchangers, and then to a second circulating carbonated water manifold. At the second carbonated water manifold the carbonated water is again mixed and then separately distributed back to an inlet line of each of the refrigeration units.

In operation, it can be appreciated that the compressed carbon dioxide gas and potable water are mixed in the carbonator to form carbonated water, which is supplied to the circulating carbonated water line located within the chilled water bath of each refrigeration unit. The carbonated water first flows to the first carbonated water manifold and co-mingles with the carbonated water from the other refrigeration units. The mixed carbonated water then flows through the first group of syrup heat exchange manifolds and then uniquely to each of the dispensing stations. Unused carbonated water, that is, water not combined with syrup and dispensed as a drink, is free to circulate back first through the remaining group of syrup heat exchange manifolds and then to a common second carbonated water manifold. The carbonated water is again co-mingled in the second carbonated water manifold and then distributed uniquely back to each refrigeration unit thereby completing the carbonated water circuit.

It can be appreciated that, should one of the refrigerated units fail, the carbonated water normally cooled thereby will be adequately cooled by co-mingling with the chilled carbonated water supplied by the other refrigeration units prior to distribution to each of the dispensing stations. As a result thereof, no one of the dispensing stations has to be taken out of service. Likewise, the syrup from each refrigeration unit is co-mingled in a unique syrup manifold. Thus, if one of the refrigeration units fails, though the syrup passing through the water bath thereof will not be chilled, it will be adequately cooled when co-mingled with the chilled syrup from the other operating refrigeration units. Thus, as the co-mingled syrups are subsequently separately distributed to each of the dispensing stations, no one of the dispensing stations needs to be taken out of service as a result of lack of syrup cooling due to the loss of one cooling unit. Moreover, the inoperative cooling unit can be easily disconnected from the various fluid lines and replaced with a fresh unit. Therefore, the present invention provides for a high capacity beverage dispensing system wherein loss of a refrigeration unit does not require the shut-down of a dispensing station and its associated valves, as there is no longer a one-to-one correlation or reliance therebetween.

BRIEF DESCRIPTION OF THE DRAWINGS

Other objects and advantages of the present invention can be had by reference to the following detailed description, which refers to the following figures wherein:

An embodiment of the present invention is seen in FIG. 1 and generally designated 10. This embodiment includes three refrigeration units 12, 14 and 16. As seen in FIG. 2, each of the refrigeration units 12, 14 and 16 include a water bath 18 having an evaporator 20 therein. Evaporator 20 is connected to a condenser 22 and compressor 24. A circulating carbonated water line 26 extends through water bath 18 and includes an outlet end **26*a* and an inlet end 26*b*. A carbonator 28 is connected to a regulated source of compressed carbon dioxide gas 30 over a carbon dioxide gas line 32 and connected to a source of potable water, not shown, over a water line 34. Carbonator 28 has an outlet line 36 for providing carbonated water to circulating line 26 through a T-fitting 38. As seen in FIG. 1, each refrigeration unit 12, 14 and 16 is responsible for cooling carbonated water, each having its own circulating carbonated water line designated C1, C2 and C3. Cooling units 12, 14 and 16 are also responsible for the cooling of six individual syrup flavors. The syrups are the same for each cooling unit 12, 14 and 16, and lines S1–S6 each carry one of the corresponding six syrup flavors from supply tanks T1–T6 thereof, and extend through water bath 18 in a serpentine fashion for providing cooling of the syrup. Gas source 30 provides for pressurization of the syrups by connection of lines S1–S6 with compressed gas lines 39**.

Figure 1:
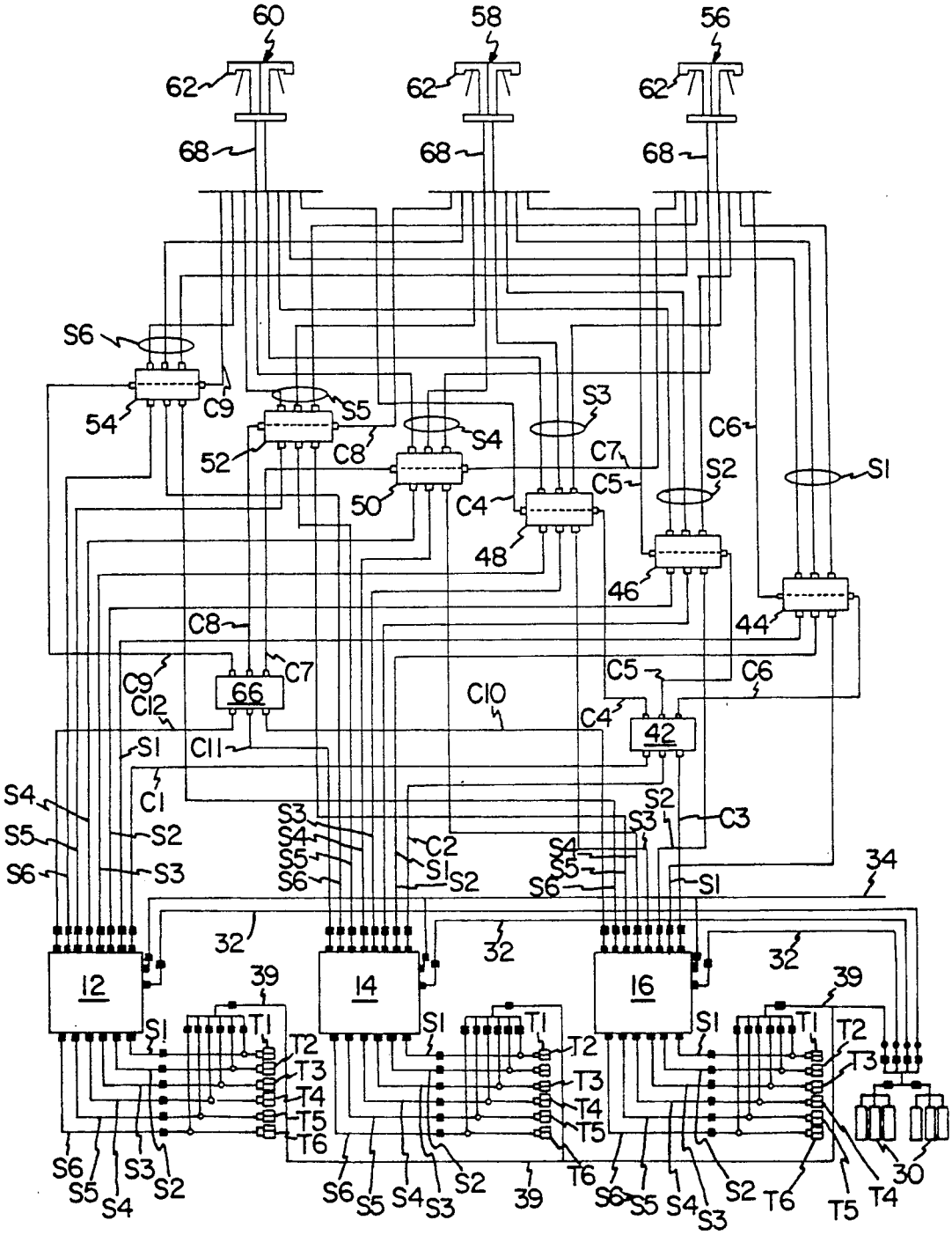
FIG. 1 shows a schematic representation of an embodiment of the present invention.
Figure 2:
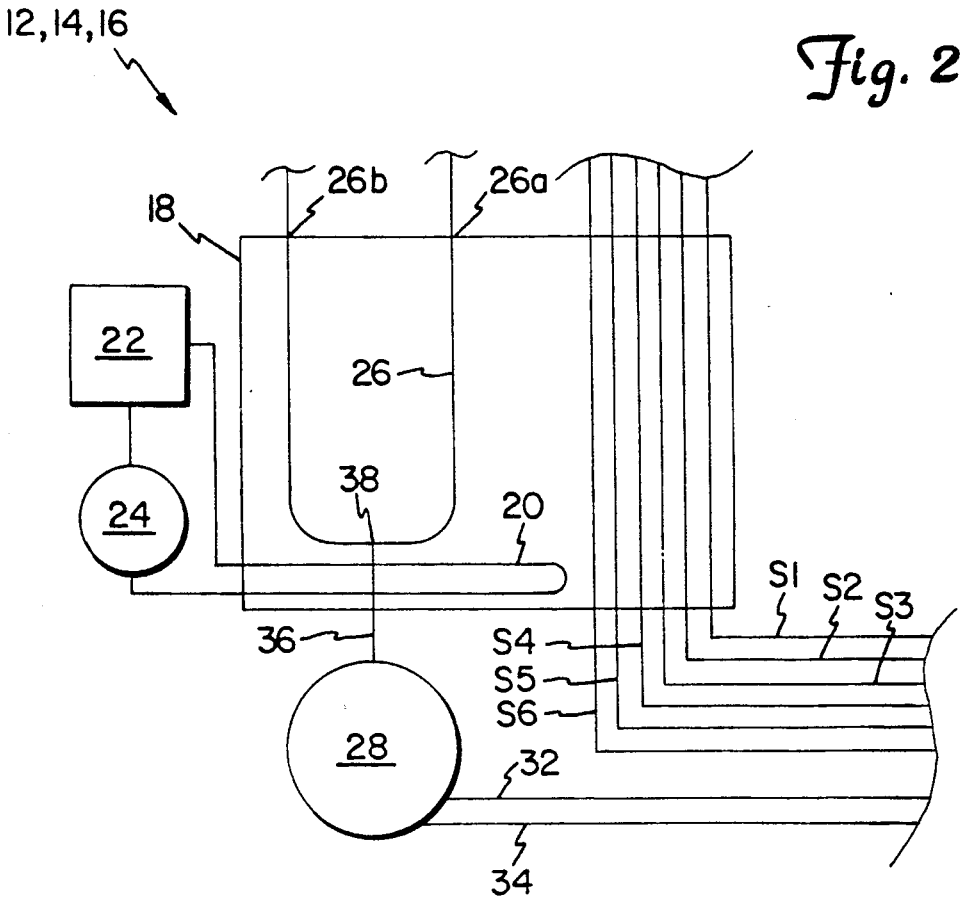
FIG. 2 shows a schematic representation of a refrigeration unit and associated components.
Figure 3:
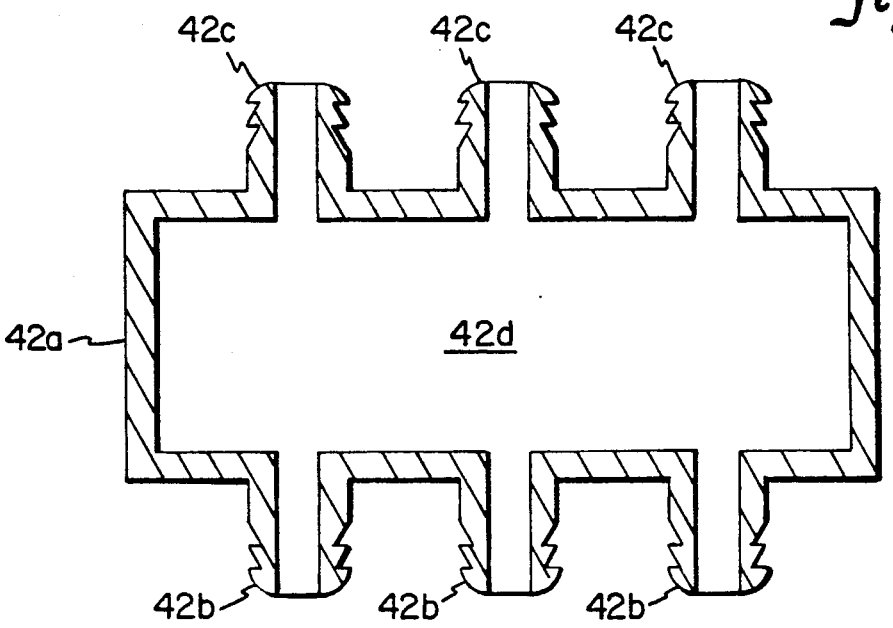
FIG. 3 shows a cross-sectional view of a heat exchange syrup manifold.
Figure 4:
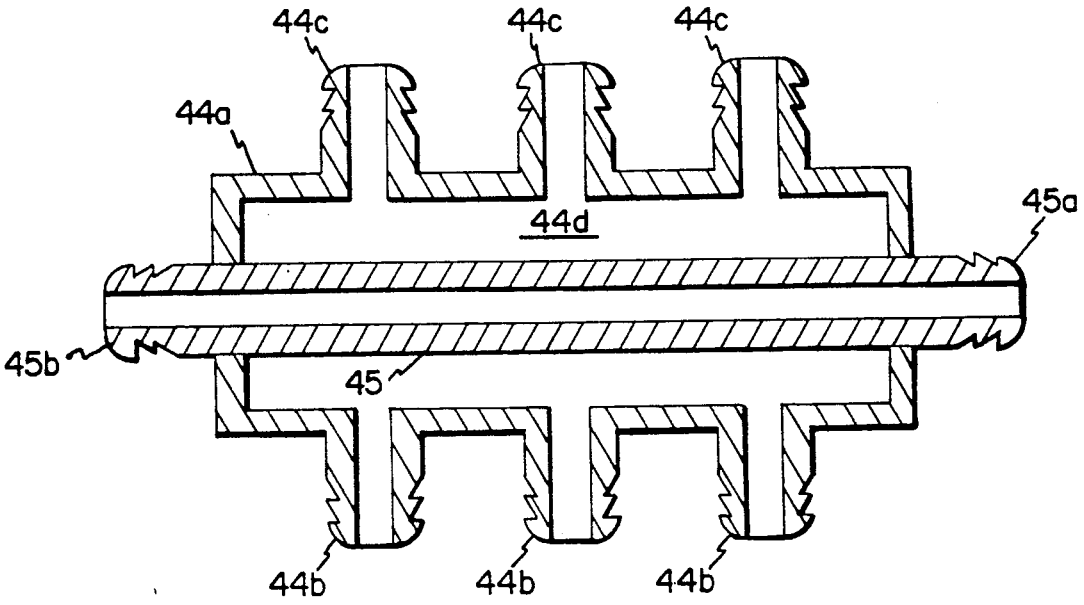
FIG. 4 shows a cross-sectional view of a carbonated water manifold.

Circulating carbonated water lines C1, C2 and C3 provide for delivery of cooled carbonated water to an outgoing carbonated water manifold 42. A cross-section of manifold 42 is seen in FIG. 3 and includes an exterior housing 42*a*, three inlet fittings 42*b*, three outlet fittings 42*c* and an interior mixing plenum or chamber 42*d*. Each outlet 42*c* of manifold 42 is connected to a circulating carbonated water line portion C4, C5 and C6. Lines C4, C5 and C6 extend firstly separately to three of six syrup heat exchange manifolds 44, 46, 48, 50, 52 and 54. Syrup manifold 44 is shown in cross-section in FIG. 4 and it will be understood that manifold 44 is representative and identical with manifolds 46, 48, 50, 52 and 54. Manifold 44 includes a housing 44*a* having a heat exchange tube 45 extending therethrough having an inlet hose fitting 45*a* and outlet hose fitting 45*b*. It will be understood that the tube 45 forms a heat exchange segment of line portions C4, C5 and C6. Housing 44*a* includes inlet tube fittings 44*b* and outlet tube fittings 44*c* and defines an interior syrup mixing and heat exchange chamber 44*d*. Lines C4, C5 and C6 continue from manifolds 48, 46 and 44 to beverage dispensing stations 56, 58 and 60. As is understood in the art, beverage stations 56, 58 and 60 each include a plurality of beverage dispensing valves 62 and, in this example, 6 valves 62 for providing mixing of the individual syrups with carbonated water for dispensing of a drink therefrom.

Figure 5:
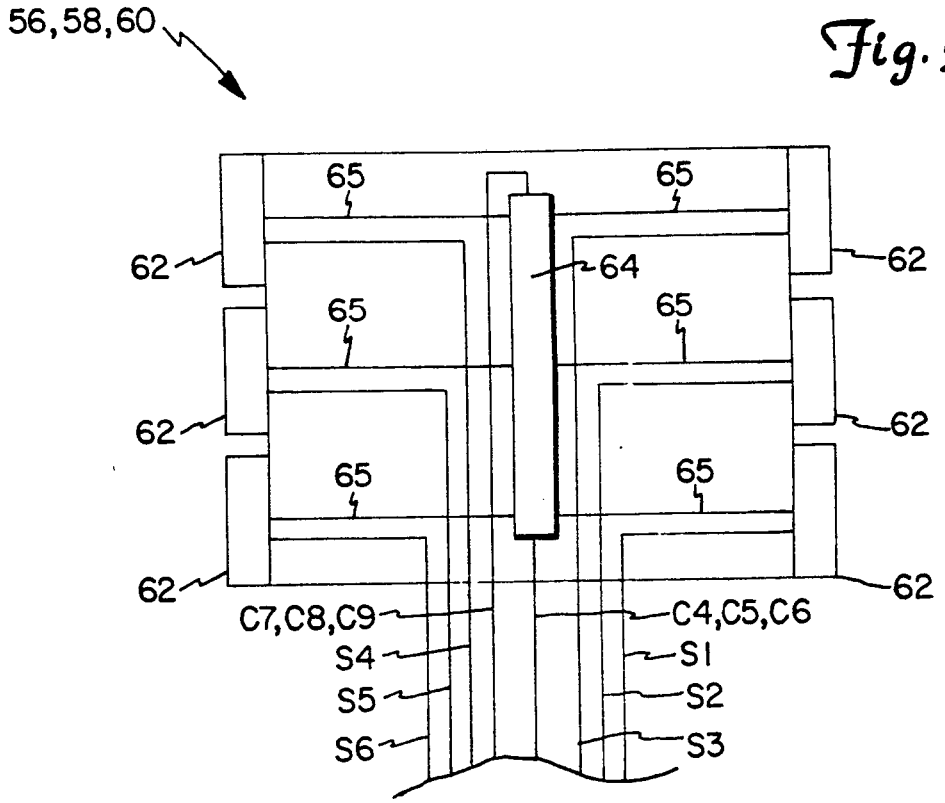
FIG. 5 shows a schematic representation of a dispensing station.

As seen in FIG. 5, a carbonated water manifold 64 is provided at each station 56, 58 and 60 for delivering carbonated water to each of the plurality of valves 62 over lines 65, and for providing a continuation of the re-circulating of the over supply of carbonated water, that is the water not immediately dispensed by valves 62. Thus, each manifold 64 is connected to return circulating carbonated water line portions C7, C8 and C9, respectively. Circulating carbonated water lines C7, C8 and C9 pass through syrup heat exchange manifolds 50, 52 and 54 respectively, as previously described with respect to lines C4, C5 and C6 and manifolds 44, 46 and 48. Lines C7, C8 and C9 then continue to a carbonated water outlet mixing manifold 66. Manifold 66 is identical to that of manifold 42, as previously described, and provides for the mixing of the carbonated water provided by each of lines C7, C8 and C9 thereto. Manifold 66 then distributes the carbonated water mixed therein along lines C10, C11 and C12 to each refrigeration unit for fluid completion of the carbonated water circuit.

As previously described, each of the refrigeration units 12, 14 and 16 are also responsible for cooling each of their respective six syrups carried in syrup lines S1–S6. Each set of beverage lines S1–S6 carry the same syrup therealong uniquely to each of the six syrup heat exchange manifolds 44, 46, 48, 50, 52 and 54. Thus, each of the same flavor of syrup from each refrigeration unit is co-mingled in a particular syrup manifold. Syrup lines S1–S6 continue from each syrup manifold to each dispensing station 56, 58 and 60.

As is understood in the art, pythons 68 are formed by the combination of lines S1–S6 and C4–C9 to provide for additional heat exchange therebetween and insulating thereof, particularly where there exists a substantial distance between the refrigeration units and the dispensing stations.

In operation, it can be understood that pump 19 provides for circulating of carbonated water from each refrigeration unit 12, 14 and 16 respectively to manifold 42. From manifold 42 the carbonated water is delivered separately to manifolds 64 of beverage dispensing stations 56, 58 and 60. Carbonated water not dispensed from manifolds 64 travels therefrom over lines C7, C8 and C9 through syrup manifold 50, 52 and 54 to outlet manifold 66. The carbonated water is again mixed in manifold 66 before being individually distributed back along lines C10, C11 and C12 to refrigeration units 12, 14 and 16. Thus, it can be appreciated that a continuous supply of cool carbonated water is provided at the various dispensing stations and, through the use of heat exchange manifolds 44, 46, 48, 50, 52 and 54, additional syrup cooling is provided for.

It can now be appreciated that, should one of the refrigeration units cease to provide cooling power, the carbonated water circulated through the water bath thereof will nevertheless be co-mingled with the cooled carbonated water from the cooling units that remain operating. Thus, cool carbonated water will continue to be distributed to each of the dispensing stations 56*a*, 56*b* and 56*c*. Failure of one of the refrigeration units will not remove one of these dispensing stations entirely from operation. In a similar manner, it can be understood that beverage syrup heat exchange manifolds 44, 46, 48, 50, 52 and 54 provide for co-mingling of each of the same flavor of syrups. Thus, should cooling of six of the syrups be eliminated by the failure of one of the refrigeration units, mixture with the cooled syrup from the remaining units will provide for sufficient cooling thereof, thereby not requiring the shut-down of any beverage dispensing station or particular valves associated therewith.

It can be appreciated by those of skill that the disclosed embodiment is a representative example of a wide variety of dispensing systems that are considered included within the scope of the present invention. In particular, any plurality of refrigeration units could be used with one or more dispensing stations. Moreover, the disclosed embodiment shows a system for the dispensing of carbonated beverages wherein a carbonated water and syrup component are mixed to form the dispensed drink. It will be understood by those of skill that the present invention has equal utility and application for use with beverages such as beer, wherein no mixing occurs between the circulated liquid coolant and the dispensed beverage. Thus, for example, the circulating system of lines 26 and C1–C12 could carry non-carbonated water solely for beverage cooling purposes.

What is claimed is:

1. A beverage dispensing system comprising:

a plurality of beverage dispensing valves, and a plurality of beverage lines for providing delivery of at least one beverage from at least one source thereof to each valve, a plurality of refrigeration means for refrigerating a coolant, and a first circulating coolant line connected to each refrigeration means for providing a flow of coolant therethrough in a downstream direction therealong from the refrigeration means to a first coolant mixing manifold, the first manifold for co-mingling of the coolant delivered therein, the first manifold fluidly connected to a second coolant circulating line, a portion of the second line in heat exchange relation with a portion of at least one beverage line for providing cooling of the beverage carried thereby.

2. The beverage dispensing system as defined in claim 1, and the second coolant line in fluid communication with each refrigeration means for providing re-circulating of the coolant.

3. The system as defined in claim 1, and each beverage line having a beverage heat exchange manifold therealong and each heat exchange manifold providing for heat exchange contact along at least one beverage cooling line.

4. A beverage dispensing system comprising:

a plurality of refrigeration means, each refrigeration means responsible for cooling a plurality of beverages, a plurality of beverage dispensing stations, each beverage flowing from a source thereof along a beverage line to one of the plurality of beverage dispensing stations for dispensing therefrom from a dispensing valve means, the dispensing valve means at each station forming separate groups of dispensing valve means, and each refrigeration means for cooling a liquid coolant, and a first circulating coolant line connected to each refrigeration means for providing a flow of coolant therethrough in a downstream direction therealong from the refrigeration means to a first coolant mixing manifold, the first manifold for co-mingling of the coolant delivered therein, the first manifold having one outlet for each of the groups of the dispensing valve means for connecting to a second coolant circulating lines for providing flow of coolant individually to each such group, and a portion of each second coolant line in heat exchange relation with the group to which the second coolant line delivers a flow of coolant for providing cooling of the beverages delivered to each valve means.

5. The beverage dispensing system as defined in claim 4, and each second coolant circulating line in fluid communication with a second coolant manifold in a direction downstream from the valve groups for co-mingling of the coolant therein and the second manifold for distributing the coolant to each refrigeration means for providing re-circulating of the coolant.

6. The system as defined in claim 5, and the coolant being carbonated water and each group having a dispensing manifold fluidly connected between the second line and the second manifold and the dispensing manifold fluidly connected to each valve means.

7. The system as defined in claim 5, wherein each beverage line carrying a same beverage is fluidly connected to a particular beverage mixing manifold for mixing of the same beverage therein and each such beverage mixing manifold separately fluidly connected to each valve means of each group responsible for the dispensing of the particular same beverage.

8. The system as defined in claim 7, and each beverage mixing manifold providing for heat exchange between the beverage therein and said second coolant line.

9. A beverage dispensing system comprising:

a plurality of refrigeration means, each refrigeration means responsible for cooling a plurality of beverages, a plurality of beverage dispensing stations, each beverage flowing from a source thereof along a beverage line to one of the plurality of beverage dispensing stations for dispensing therefrom from a dispensing valve means, the dispensing valve means at each station forming separate groups of dispensing valve means, and each refrigeration means for cooling a liquid coolant, and a first circulating coolant line connected to each refrigeration means for providing a flow of coolant therethrough in a downstream direction therealong from the refrigeration means to a first coolant mixing manifold, the first manifold for co-mingling of the coolant delivered therein, the first manifold having one outlet for each of the groups of the dispensing valve means for connecting to a second coolant circulating line for providing flow of coolant individually to each such group, and a portion of each second coolant line in heat exchange relation with the group to which the second coolant line delivers a flow of coolant for providing cooling of the beverages delivered to each valve means, and each beverage line carrying a same beverage fluidly connected to a particular beverage mixing manifold for mixing of the same beverage therein and each such beverage mixing manifold separately fluidly connected to each valve means of each group responsible for the dispensing of the particular same beverage.

10. The beverage dispensing system as defined in claim 9, and each second coolant circulating line in fluid communication with a second coolant manifold in a direction downstream from the valve groups for co-mingling of the coolant therein and the second manifold for distributing the coolant to each refrigeration means for providing re-circulating of the coolant.

11. The system as defined in claim 10, and the coolant being carbonated water and each group having a dispensing manifold fluidly connected between the second line and the second manifold and the dispensing manifold fluidly connected to each valve means.

12. The system as defined in claim 9, and each beverage mixing manifold providing for heat exchange between the beverage therein and said second coolant line.

13. A beverage dispensing system comprising:

a plurality of refrigeration means, a plurality of beverage dispensing stations, each station for dispensing a plurality of beverages, each beverage flowing from a source thereof along a beverage line to one of the plurality of beverage dispensing stations for dispensing from a dispensing valve means, the dispensing valve means at each station forming separate groups of dispensing valve means, and each refrigeration means for cooling a liquid coolant, and a first coolant circulating line connected to each refrigeration means for providing a flow of coolant therefrom in a downstream direction to a first coolant mixing manifold, the first manifold for co-mingling of the coolant delivered therein, second circulating coolant lines, the second lines for providing flow of coolant individually to each valve group, and a portion of each second coolant line in heat exchange relation with the beverage lines of the valve group to which the second coolant line delivers a flow of coolant for providing cooling of the beverages delivered to each valve means.

14. The beverage dispensing system as defined in claim 13, and each second coolant line providing for return flow of coolant from its respective valve group uniquely to one of the refrigeration means.

15. The beverage dispensing system as defined in claim 13, and each second coolant line in fluid communication with a second coolant manifold in a direction downstream from the valve groups for co-mingling of the coolant therein and the second manifold for distributing the coolant to each refrigeration means for providing re-circulating of the coolant.

16. The beverage dispensing system as defined in claim 13, and the coolant being carbonated water and each group having a dispensing manifold fluidly connected between the first manifold and the valve means of each group.

17. The beverage dispensing system as defined in claim 16, and further including third coolant lines providing for return flow of coolant from each dispensing manifold uniquely to one the refrigeration means.

18. The system as defined in claim 13, wherein the beverage lines delivering beverage to a particular valve group flow first from the source thereof to one of the refrigeration means for cooling thereby prior to flowing to the respective valve group.

19. The system as defined in claim 18, wherein each beverage line carrying a same beverage from a refrigeration means is then fluidly connected to a particular beverage mixing manifold for mixing of the same beverage therein and each such beverage mixing manifold separately fluidly connected to each valve of each group responsible for the dispensing of the particular same beverage.

20. The system as defined in claim 19, and each beverage mixing manifold providing for heat exchange between the beverage therein and one of the second coolant lines.

21. A beverage dispensing system comprising:

a plurality of refrigeration means, a plurality of beverage dispensing stations, each station for dispensing a plurality of beverages, each beverage flowing from a source thereof along a beverage line to one of the plurality of beverage dispensing stations for dispensing from a dispensing valve means, the dispensing valve means at each station forming separate groups of dispensing valve means, and each refrigeration means for cooling a liquid coolant, and a first coolant circulating line connected to each refrigeration means for providing a flow of coolant therefrom in a downstream direction to a first coolant mixing manifold, the first manifold for co-mingling of the coolant delivered therein, second circulating coolant lines, the second lines for providing flow of coolant individually to each valve group, and a portion of each second coolant line in heat exchange relation with the beverage lines of the valve group to which the second coolant line delivers a flow of coolant for providing cooling of the beverages delivered to each valve means, and each second coolant line in fluid communication with a second coolant manifold in a direction downstream from the valve groups for co-mingling of the coolant therein and the second manifold for distributing the coolant to each refrigeration means for providing re-circulating of the coolant.

22. The beverage dispensing system as defined in claim 21, and the coolant being carbonated water and each group having a dispensing manifold fluidly connected between the first manifold and the valve means of each group and each dispensing manifold fluidly connected to the second manifold.

23. The system as defined in claim 22, wherein the beverage lines delivering beverage to a particular valve group flow first from the source thereof to one of the refrigeration means for cooling thereby prior to flowing to the respective valve group.

24. The system as defined in claim 23, wherein each beverage line carrying a same beverage from a refrigeration means is then fluidly connected to a particular beverage mixing manifold for mixing of the same beverage therein and each such beverage mixing manifold separately fluidly connected to each valve of each group responsible for the dispensing of the particular same beverage.

25. The system as defined in claim 24, and each beverage mixing manifold providing for heat exchange between the beverage therein and one of the second coolant lines.

* * * * *